US011285744B2

(12) United States Patent
Clotet Marti et al.

(10) Patent No.: US 11,285,744 B2
(45) Date of Patent: Mar. 29, 2022

(54) DETECTING ARTEFACTS ON PRINTABLE SUBSTRATES

(71) Applicant: HEWLETT-PACKARD DEVELOPMENT COMPANY, L.P., Spring, TX (US)

(72) Inventors: Marc Clotet Marti, Sant Cugat del Valles (ES); Cesar Serpa Rosa, Sant Cugat del Valles (ES); Xavier Gomez Travesset, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/498,694

(22) PCT Filed: Apr. 30, 2018

(86) PCT No.: PCT/US2018/030131
§ 371 (c)(1),
(2) Date: Sep. 27, 2019

(87) PCT Pub. No.: WO2019/212467
PCT Pub. Date: Nov. 7, 2019

(65) Prior Publication Data

US 2021/0402807 A1 Dec. 30, 2021

(51) Int. Cl.
*B41J 29/00* (2006.01)

(52) U.S. Cl.
CPC ..... *B41J 29/00* (2013.01); *B41J 2203/011* (2020.08)

(58) Field of Classification Search
CPC ..... B41J 29/00; B41J 2203/011
See application file for complete search history.

(56) References Cited

U.S. PATENT DOCUMENTS

| | | | | |
|---|---|---|---|---|
| 4,480,546 | A | 11/1984 | Uno et al. | |
| 2004/0008230 | A1 | 1/2004 | Kelley et al. | |
| 2007/0009275 | A1 | 1/2007 | Yokoyama | |
| 2011/0279507 | A1 | 11/2011 | Castillo et al. | |
| 2013/0300794 | A1 | 11/2013 | Leighton et al. | |
| 2016/0129707 | A1 * | 5/2016 | Kojima | B65H 43/08 347/16 |
| 2016/0257150 | A1 | 9/2016 | Verdugo et al. | |
| 2017/0274644 | A1 | 9/2017 | Shinohara | |

(Continued)

FOREIGN PATENT DOCUMENTS

| | | |
|---|---|---|
| CN | 202924417 | 5/2013 |
| CN | 106626811 A | 5/2017 |
| JP | H02283471 | 11/1990 |

(Continued)

*Primary Examiner* — Justin Seo
(74) *Attorney, Agent, or Firm* — HP Inc. Patent Department

(57) ABSTRACT

An apparatus is disclosed. The apparatus is to detect an artefact on a printable surface. The apparatus comprises a detection element to engage the printable surface as the printable surface moves relative to the detection element, and to move away from the printable surface when an artefact passes between the detection element and the printable surface. The apparatus also comprises an actuator to be actuated in response to the detection element moving beyond a defined distance from the printable surface. A method and a print apparatus are also disclosed.

15 Claims, 5 Drawing Sheets

(56) References Cited

U.S. PATENT DOCUMENTS

2017/0334193 A1 11/2017 Voina et al.

FOREIGN PATENT DOCUMENTS

| | | | |
|---|---|---|---|
| JP | H04265777 | A | 9/1992 |
| JP | 2001328246 | | 11/2001 |
| JP | 2005324400 | | 11/2005 |
| JP | 2007001185 | | 1/2007 |
| JP | 2010221644 | | 10/2010 |
| JP | 2013079138 | | 5/2013 |

* cited by examiner

DETECTING ARTEFACTS ON PRINTABLE SUBSTRATES

BACKGROUND

In an example printing system, a substrate on which an image is to be printed is moved under a print head. Print agent, such as ink, is deposited from the print head onto the substrate in order to form the image.

BRIEF DESCRIPTION OF DRAWINGS

Examples will now be described, by way of non-limiting example, with reference to the accompanying drawings, in which.

DETAILED DESCRIPTION

In a printing apparatus, a print head, or print agent distributor, may be used to deposit print agent, such as ink, onto a printable substrate. The print head may include a nozzle, or multiple nozzles, from which print agent may be ejected onto the substrate. The print head, or multiple print heads, may be mounted to a carriage which moves (e.g. scans) over a width of the substrate to deposit the print agent in the intended image to be printed.

The printable substrate on which the image is to be printed may comprise individual sheets of substrate or a web or roll of printable material. For example, the substrate may comprise paper, cardboard, plastics material, glass, ceramics, metal, wood or the like.

The nozzles of the print head may, in some print apparatuses deposit print agent onto the substrate from a relatively small distance above the surface of the substrate. In other words, there may exist a relatively small separation between the nozzles of the print head and the substrate to be printed. In some examples, the separation between the print head nozzles and the substrate may be 2.3 mm+1-0.5 mm. For example, in some print apparatuses, separation between the print head nozzles and the substrate may be 2.8 mm while, in other print apparatuses, the separation between the print head nozzles and substrate may be as little as 1.8 mm. In other examples, the separation may be greater or smaller. If an object having a height greater than the separation between the print head nozzles and the substrate were to move with the substrate towards the print head, there is a risk that the object would collide with the print head nozzles and could, potentially, damage one of the print head nozzles, multiple nozzles of the print head, or some other part of the print head. A similar risk of damage exists due to defects of the substrate. For example, a folded or upturned edge or corner of a substrate to be printed, or a wrinkle or ridge in the substrate may stand proud of the surface of the substrate, and could collide with, and possibly damage, the print head or its nozzles. The term "artefact" is used herein to describe protuberances, wrinkles, objects, defects or abnormalities associated with the substrate which could collide with the print head or its nozzles during a printing operation. For example, an artefact may comprise an object positioned on, or stuck to, the substrate. In some examples, an artefact may comprise a physical defect of the substrate.

Aspects of the present disclosure provide a mechanism by which artefacts associated with a printable substrate may be detected. If such an artefact is detected, appropriate action may be taken to prevent the artefact from encountering or colliding with any part of the print head so that the risk of damage may be reduced.

Figure 1A:
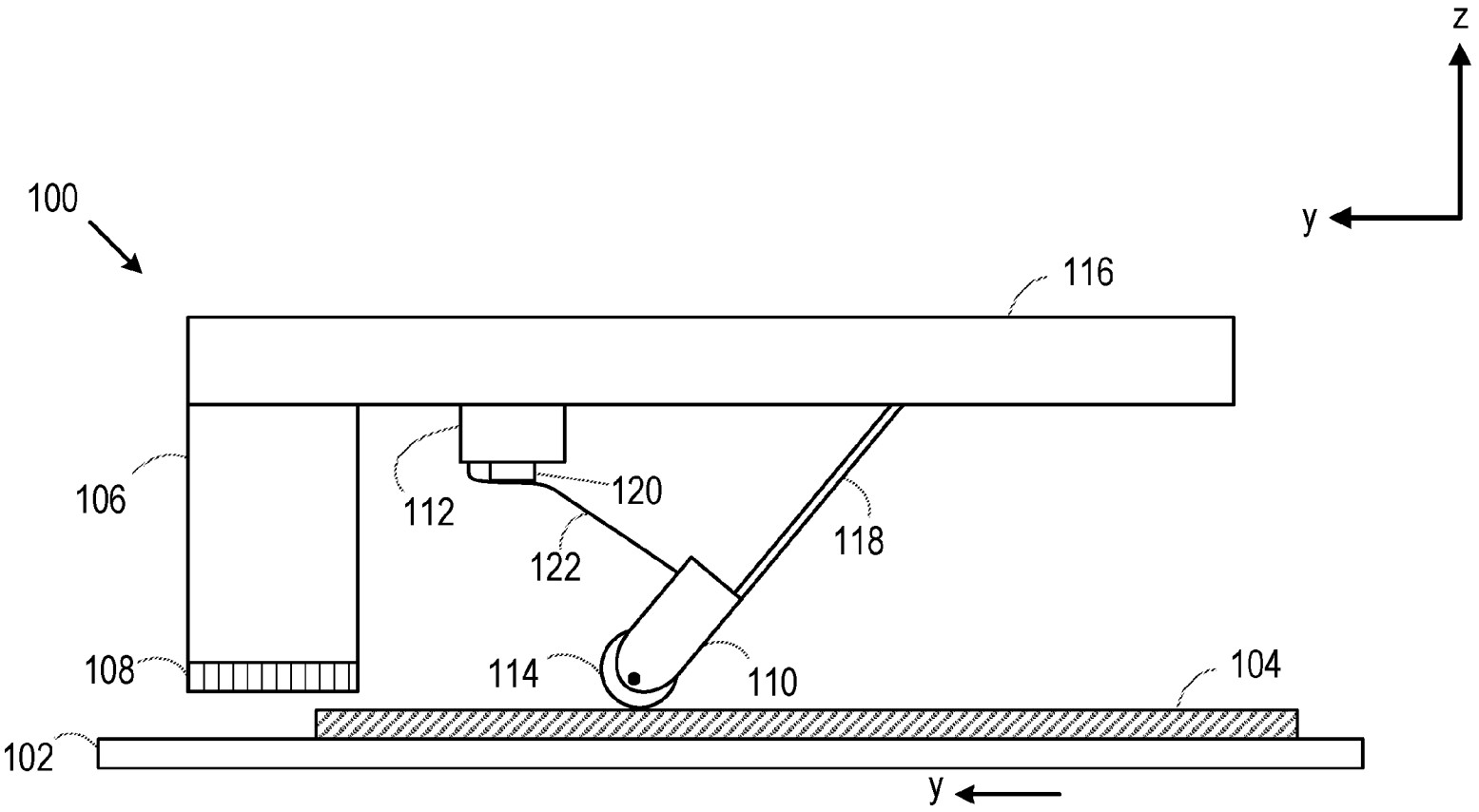
FIG. 1*a* is a simplified schematic of an example of a print apparatus and an artefact detection apparatus.
Figure 1B:
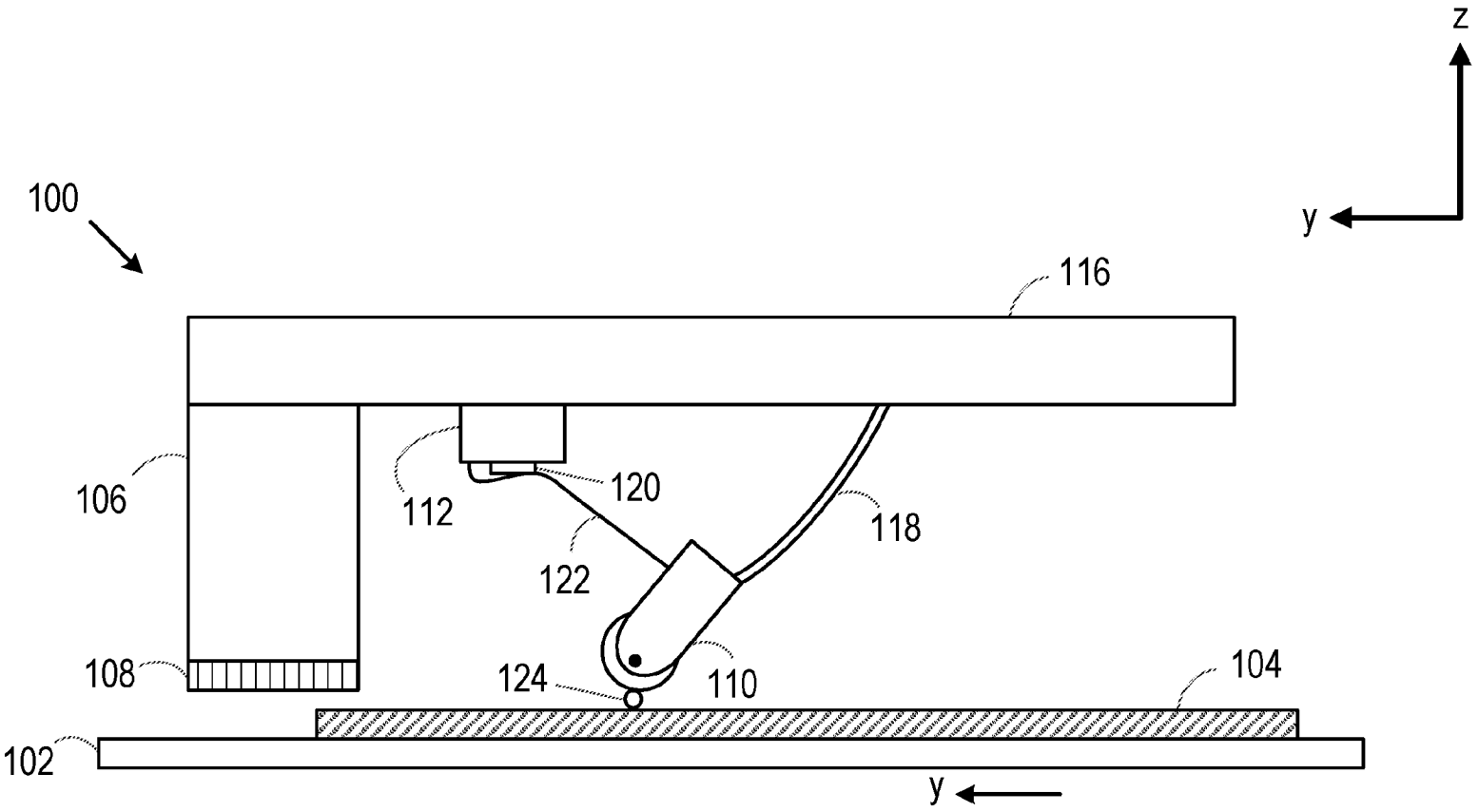
FIG. 1*b* is a simplified schematic of a further example of a print apparatus and an artefact detection apparatus.

Referring to the drawings, FIGS. 1*a* and 1*b* are simplified schematics of part of a print apparatus 100 and an artefact detection mechanism. Referring, first, to FIG. 1*a*, the print apparatus 100, shown in side view, includes a platen 102 to support a substrate 104 to be printed. The print apparatus 100 also includes a print head 106 having nozzles 108 from which print agent may be ejected. The substrate 104 may move from a substrate source (not shown) along the platen 102 towards the print head 106 in the y direction. The platen 102 may, in some examples, include, or function in association with, a belt, a series of rollers, or some other conveying mechanism or movement mechanism for moving the substrate 104 towards the print head 106 to be printed. Once the substrate 104 has been moved into an intended position relative to (e.g. beneath) the print head 106 and the nozzles 108, print agent may be delivered from a print agent source (e.g. a reservoir) (not shown), via the print head and nozzles, onto the substrate.

The artefact detection mechanism in the examples of FIGS. 1*a* and 1*b* comprises a detection element 110 and an activation element or actuator 112 which, together, function to detect an artefact associated with the substrate 104. In the example shown, the detection element 110 comprises a roller 114 to engage and rotate relative to the substrate 104 as the substrate moves over the platen 102 towards the print head 106. In other examples, the detection element 110 may not include a roller, and may slide over the substrate 104 as the substrate moves over the platen 102. In other examples, the detection element 110 may be spaced apart from the substrate. The detection element 110 may be connected to or mounted to part of the print apparatus 100. For example, as shown in FIGS. 1*a* and 1*b*, the detection element 110 may be mounted to a mounting beam 116 of the print apparatus 100. In some examples, including the example shown in FIGS. 1*a* and 1*b*, a carriage (not shown) carrying the print head 106 may also be connected or mounted, directly or indirectly, to the mounting beam 116. For example, a carriage carrying the print head 106 may move in an x direction along a scan axis beam (not shown) attached to the mounting beam 116.

The detection element 110 may be attached to the mounting beam 116 via an arm 118. The arm 118 may, in some examples, comprise a resilient member to urge the detection element 110 towards the platen 102. In this way, as the substrate 104 moves over the platen 102 and beneath the detection element 110, the detection element is to apply a downward, compressive force to the substrate. Thus, the detection element 110 may compress the substrate 104 against the platen 102, or against the mechanism used to move the substrate over the platen. The arm 118 may, in some examples, comprise a piece of metal shaped to function as a spring, such as a leaf spring. In some examples, a pinch wheel (also referred to as a pinch roller) of a print apparatus may be used to function as the detection element 110. A pinch wheel, or multiple pinch wheels, may be used to apply a downward, compressive force onto the substrate 104 to aid alignment of the substrate relative to the print head 106. In some examples, a pinch wheel or pinch roller may "pinch" or "grab" the substrate 104 to feed it into the print apparatus, or towards the print head of the print apparatus.

The actuator 112 may include an actuation mechanism, such as a contact (e.g. an electrical contact), a switch, a button, or a touchpad which, when touched, compressed, pressed or moved, may cause actuation or activation of the actuator 112. In other examples, other actuation mechanisms may be implemented. In the example shown in FIGS. 1*a* and 1*b*, the actuation mechanism comprises a mechanical button 120 which, when pressed, puts the actuator 112 into an actuated state. The detection element 110 can interact with (e.g. press) the button 120 by a trigger arm or activator arm 122 as described below.

FIG. 1*a* shows the print apparatus 100 with a substrate 104 which does not have an artefact located formed thereon. Thus, in the example shown in FIG. 1*a*, the roller 114 of the detection element 110 rests upon an upper surface of the substrate 104, and applies a downward force onto the substrate as a result of the biasing force provided by the arm 118. In this example, the activator arm 122 does not press the button 120 of the actuator 112. For example, the activator arm 122 may be spaced apart from the button 120. It will be appreciated that, in other examples, the activator arm 122 may be omitted altogether. In such examples, a portion of the detection element 110 may press the button 120 of otherwise cause actuation of the actuator 112.

In the example shown in FIG. 1*b*, an artefact 124 is located on the substrate 104. While the artefact 124 is shown in FIG. 1*b* as an object (e.g. a foreign object which may have fallen inadvertently onto the substrate 104), the artefact may comprise a defect in or on the substrate itself, such as a crease, a tear or a fold in an edge, a corner or on a surface of the substrate. As the artefact 124 engages the detection element 110 (or the roller 114 of the detection element 110 in the example of FIGS. 1*a* and 1*b*), the detection element 110 is caused to lift up from the surface of the substrate 104 such that the artefact is able to pass between the substrate and the detection element 110, i.e., the detection element is moved away from the substrate in a direction with a component in the z axis as shown in FIGS. 1*a* and 1*b*. The movement of the detection element upwards from the surface of the substrate 104 may, for example, be enabled by flexing of the arm 118. Thus, when the artefact 124 encounters the detection element 110, the detection element is urged upwards, against the downwards biasing force supplied by the arm 118. It will be appreciated that, in other examples, the arm 118 may function in some other way. For example, the arm 118 may be connected to the mounting beam 116 by a pivoted connection, such that, as an artefact passes between the detection element 110 and the substrate 104, the arm is caused to pivot upwards, thereby causing the detection element to move upwards towards the actuator 112.

As the detection element 110 is moved upwards away from the surface of the substrate 104, the activator arm 122 is caused to activate the actuation mechanism 120. For example, contact between the activator arm 122 and the actuation mechanism 120 may put the actuator 112 into an actuated state. In the examples of FIGS. 1*a* and 1*b*, when the detection element 110 is moved upwards, the activator arm 122 (or a portion thereof) is caused to apply a force onto the button 120, causing the button to be pressed, and causing actuation of the actuator 112. It will be appreciated that the activator arm 122 will be caused to press the button 120 if it is moved upwards by a sufficient amount, determined by the allowed movement of the button. Thus, in this example, the button 120 will be pressed if the detection element 110 is urged away from the surface of the substrate 104 by a distance exceeding a threshold distance. Such movement of the detection element 110 may result if the artefact 124 passing between the detection element and the substrate 104 is of a sufficient size (e.g. if the artefact has a height exceeding a defined threshold height). If an artefact smaller than the threshold size passes between the detection element 110 and the substrate 104, the detection element may be caused to lift up, but not sufficiently to actuate the actuator 112. It will be apparent that, in some examples, in order to prevent an artefact 124 from colliding with the nozzles 108 of the print head 106, the button 120 is to be pressed if the movement of the detection element 110 away from the substrate 104 is equal to or exceeds the separation between the nozzles and the substrate. As noted above, the separation between the nozzles 108 and the substrate 104 may, in some examples, range from around 1.8 mm to 2.8 mm. Therefore, in such examples, the actuator 112 is to be actuated (e.g. the button 120 is to be pressed) if the movement of the detection element 110 away from the substrate 104 is equal to or greater than 1.8 mm. In other examples, the artefact detection mechanism may be such that the actuator 112 is to be actuated in response to the detection element 110 moving some other distance away from (e.g. in a direction substantially normal to) the substrate 104, such as 0.5 mm, 1 mm or 1.5 mm.

Upon actuation of the actuator 112 (e.g. by pressing the button 120), action may be taken to prevent the artefact 124 from colliding with the nozzles 108. In some examples, movement of the substrate 104 over the platen 102 may be restricted or prevented. For example, the mechanism used to move the substrate 104 over the platen 102 may be switched off, or otherwise caused to temporarily halt movement of substrate. In some examples, the actuator 112 may be connected to or associated with processing circuitry. Upon actuation of the actuator 112, the processing circuitry may generate and send a signal, for example to another component of the print apparatus 100. The signal may comprise an instruction signal instructing a component to prevent movement of the substrate towards the print head, thereby preventing the risk of a collision between the artefact 124 and the nozzles 108.

Figure 2:
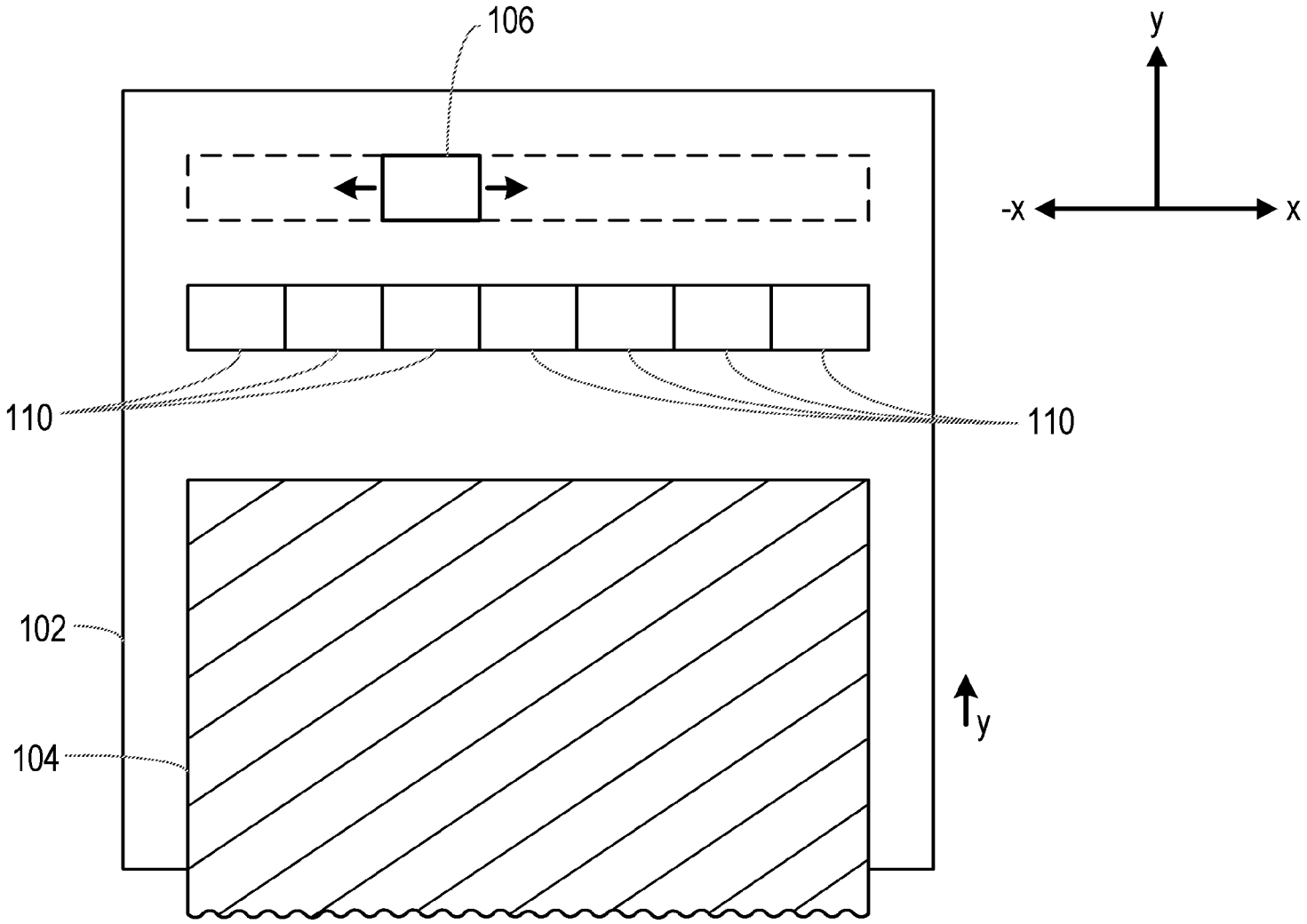
FIG. 2 is a simplified schematic showing, in plan view, an example of a print apparatus and an artefact detection apparatus.

FIG. 2 is a simplified schematic of an example of the print apparatus 100 and an artefact detection apparatus, in plan view (i.e. from above). FIG. 2 shows the platen 102, over which the substrate 104 is to be moved in the y direction. The substrate 104 is to move towards the print head 106. The print head 106 scans over the width of the substrate 104 in the x and −x directions within the region indicated by the dashed box. Print agent may be deposited through nozzles (not shown in FIG. 2) of the print head 106 as the substrate 104 moves underneath the print head. The artefact detection apparatus, in this example, includes multiple detection elements 110. Each detection element 110 may have an associated actuator 112, each having a corresponding actuation mechanism (e.g. a button 120) (not shown in FIG. 2). In other examples, each detection element 110 may have an associated actuation mechanism (e.g. a button 120) to interact with a single actuator 112. In this way, pressing any of the buttons 120 would cause the actuator 112 to be actuated.

By providing multiple detection elements 110, an artefact appearing anywhere across the width of the substrate 104 can be detected by a detection element, thereby reducing the chance that any artefact will pass the artefact detection apparatus and encounter the nozzles of the print head 106. Each detection element 110 in the example shown in FIG. 2 may, in some examples, comprise a pinch wheel of the print apparatus 100, thereby making use of existing components of the print apparatus.

In one example, the print apparatus 100 may be to print onto a substrate 104 having a width of around 3 metres. The artefact detection apparatus of the print apparatus 100 may comprise 22 pinch wheels, each of which is to function as a detection element 110 as described above. While a small gap may exist between adjacent detection elements 110, it is intended that any such separation is to be insignificant compared to the size of an artefact, such that any artefact larger than a defined size will encounter and be detected by a detection element.

Figure 3:
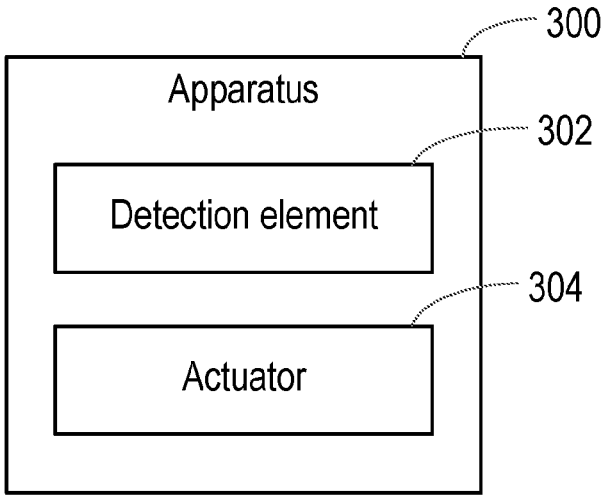
FIG. 3 is a simplified schematic of an example of an artefact detection apparatus.

Reference is now made to FIG. 3, which shows, schematically, an example of an apparatus 300. The apparatus 300 may, for example, comprise an artefact detection apparatus, or an apparatus to detect an artefact on a printable surface, as described herein. The apparatus 300 comprises a detection element 302 to engage the printable surface as the printable surface moves relative to the detection element, and to move away from the printable surface when an artefact passes between the detection element and the printable surface. The detection element 302 may, for example, comprise or be similar to the detection element 110 discussed herein. The printable surface may comprise a surface of a substrate, such as the substrate 104. Thus, the printable surface may comprise a surface onto which print agent is to be deposited via the nozzles 108 of the print head 106 as discussed herein.

When an artefact, such as the artefact 124, passes between the detection element 302 and the printable surface of the substrate, the detection element may move away from the printable surface in any suitable manner, for example in the manner described with reference to FIGS. 1*a* and 1*b*.

The apparatus 300 also comprises an actuator 304 to be actuated in response to the detection element 302 moving beyond a defined distance from the printable surface. The actuator 304 may, for example, comprise, or be similar to, the actuator 112 discussed herein. Thus, in some examples, the actuator 304 may be actuated by the detection element 302 coming into contact with or pressing a portion of the actuator (e.g. a button). In other examples, movement of the detection element 302 beyond the defined distance from the printable surface may cause some other component (e.g. a trigger arm or activator arm 122) to make contact with or press a portion of the actuator 304. For example, the actuator 304 may be triggered by electrical contact being made between a first electrical contact (e.g. the trigger arm or activator arm 122) and a second electrical contact associated with the actuator 304. Movement of the first electrical contact to engage the second electrical contact may be caused by the movement of the detection element 302 by the defined distance from the printable surface.

The artefact detection apparatus 300 provides an effective mechanism by which artefacts on a printable substrate can be detected before they encounter the nozzles of a print head. The approach described herein is capable of being mounted into existing print apparatus (e.g. by a retrofitting process). The apparatus uses an electro-mechanical arrangement and, therefore, is likely to be less expensive than alternative techniques, such as optical artefact detection systems.

In some examples, the detection element 302 may comprise a roller to roll over the printable surface as the printable surface moves relative to the roller. For example, the detection element 302 may comprise or include the roller 114 discussed above. Thus, the roller is to rotate relative to the printable surface as the printable surface moves. By incorporating a roller into the detection element 302, the detection element is able to move more easily over the surface of the substrate, with less chance of damage being caused to the substrate as the substrate moves relative to the detection element. In some examples, the detection element 302 and/or the roller may form part of a pinch wheel or pinch roller of a print apparatus. Thus, the roller may, in some examples, comprise a pinch roller positioned upstream of a print head of a print apparatus on a path along which the printable substrate is to move. A pinch wheel or pinch roller provides a convenient component to function as a detection element 302. Thus, by incorporating a pinch wheel/roller as part of the artefact detection apparatus 300, implementation costs may be reduced.

As the detection element 302 encounters an artefact (e.g. as the artefact 124 approaches and comes into contact with the detection element 110 in FIGS. 1*a* and 1*b*), the detection element may be caused to move substantially upwards to move over the artefact. Thus, the detection element 302 may, in some examples, be to move in a direction substantially normal to the printable surface when an artefact passes between the detection element and the printable surface. A direction substantially normal to the printable surface may, for example, be in the z direction, as shown in FIGS. 1*a* and 1*b*. In some examples, the mechanism enabling the detection element 302 to move as it encounters an artefact (e.g. the arm 118 in the example of FIGS. 1*a* and 1*b*) may be such that the detection element 302 is able to move just in a direction substantially normal to the printable surface or the substrate. In some examples, the movement of detection element 302 upon encountering an artefact (e.g. as the artefact passes between the detection element and the printable surface) may have a component in the direction substantially normal to the printable surface. Thus, in some examples, the detection element 302 may move in a straight path directly away from (normal to) the printable surface while, in other examples, the detection element 302 may move in a non-straight path (e.g. a curved path) away from the printable surface.

The actuator 304 is, in some examples, to be actuated when the detection element 302 detects an artefact of a size capable of engaging with and potentially damaging the print head nozzles. Thus, in such examples, actuation of the actuator 304 is intended when the detection element 302 is displaced from the surface of the printable substrate by more than the separation between the nozzles and the substrate. Since the distance between the nozzles and the substrate may vary from between different print apparatuses, and may change when different substrates are used, the distance by which the detection element 302 may move before the actuator 304 is triggered may be defined prior to commencing a printing operation. For example, the defined distance may be stored in a memory associated with the print apparatus. Thus, in some examples, the detection element 302 is to engage the actuator in response to moving beyond the defined distance from the printable substrate. As noted above, the defined distance may, in some examples, be approximately 1.8 mm. In some examples, the defined distance may range from approximately 1 mm to approximately 3 mm. In other examples, the defined distance may be based on the distance between the print head nozzles and the substrate surface.

As noted above, the artefact detection apparatus 300 may be mounted in a print apparatus having a print head to deposit print agent (e.g. ink) onto the printable surface. The print head may, for example, comprise or be similar to the print head 106 discussed herein. Thus, the print agent may be deposited onto the printable surface via nozzles (e.g. the nozzles 108). The defined distance may be equal to a distance between the print head and the printable surface. In some examples, the defined distance may be equal to a distance between the nozzles and the printable surface.

As noted above, the printable surface of the substrate may be moved over a platen towards the print head, for example by a movement mechanism (not shown in the Figures). In some examples, the apparatus 300 may be such that, in response to be actuated, the actuator 304 is to prevent movement of the printable surface relative to the detection element 302. Preventing movement of the printable surface/substrate may involve preventing the movement mechanism from moving the substrate towards the print head and, therefore, towards the detection element 302. The actuator 304 may, in some examples, be connected to, operated by and/or otherwise associated with a processor (not shown). In response to actuation of the actuator 304, the processor may generate a signal (e.g. an instruction signal). For example, the processor may send a signal to a component of the print apparatus to cause the movement of the substrate to be halted or prevented. In some examples, in response to the actuator being actuated, some other action may be taken. For example, if an artefact over a threshold size is detected (e.g. due to actuation of the actuator 304), then an alert signal may be generated (e.g. by the processor) to alert a user or operator of the print apparatus of the presence of the artefact. In this way, action may be taken before the artefact is able to crash into the print head/nozzles.

As shown in FIG. 2, an artefact detection apparatus 300 may comprise multiple detection elements 112, 302, each of which may be capable of moving away from (e.g. lifting up from) the substrate upon encountering an artefact. Thus, in some examples, the detection element 302 may be one of a plurality of detection elements and the actuator 304 may be one of a plurality of actuators. Each actuator 304 may be independently actuatable in response to a corresponding one of the plurality of detection elements 302 moving beyond a defined distance from the printable surface. In this way, the artefact detection apparatus 300 is able to detect artefacts across the entire width of the substrate to be printed. Furthermore, it is possible to detect an approximate region of the substrate within which the artefact is detected. Thus, action may quickly be taken to remove the artefact or rectify any defect identified on the substrate, with minimal downtime of the print apparatus.

Figure 4:
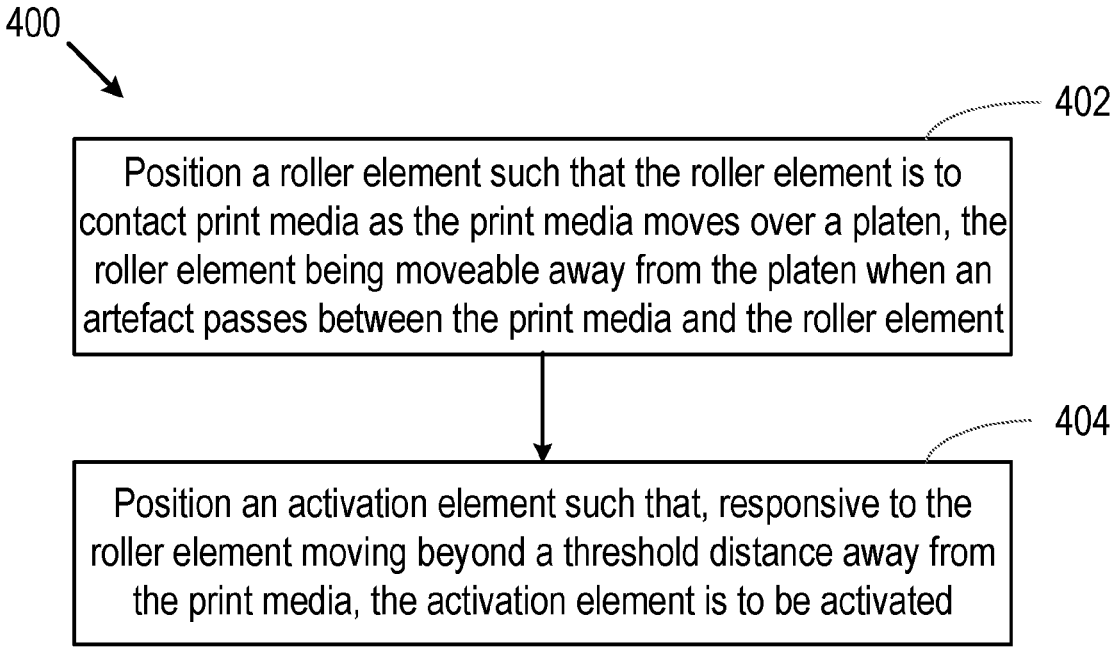
FIG. 4 is a flowchart of an example of an artefact detection method.

Another aspect of the disclosure related to a method. FIG. 4 is a flowchart of an example of a method 400. The method 400 may, in some examples, be considered to be an artefact detection method. The method 400 comprises, at block 402, providing a roller element such that the roller element is to contact print media as the print media moves over a platen, the roller element being moveable away from the platen when an artefact passes between the print media and the roller element. Providing the roller element may comprise positioning the roller element in a suitable manner. The roller element may, for example, comprise or be similar to the detection element 110, 302 and/or the roller 114 of the detection element 110, discussed above. As the roller element encounters an artefact (e.g. the artefact 124 of FIGS. 1*a* and 1*b*), the roller element is caused to move upwards from (e.g. in a direction substantially normal/perpendicular to) the print media, as the artefact passes between the print media and the roller element (e.g. beneath the roller element).

At block 404, the method 400 comprises providing an activation element such that, responsive to the roller element moving beyond a threshold distance away from the print media, the activation element is to be activated. Providing the activation element may comprise positioning the activation element in a suitable manner. The activation element may comprise or be similar to the actuator 112, 304 and may include an actuation mechanism, such as the button 120, as discussed above. In some examples, the activation element may be activated by the roller element (or a component associated therewith) as the roller element moves away from the print media. In other examples, movement of the roller element away from the print media may cause another component to activate the activation element. As noted previously, the threshold distance from the print media may be approximately equal to the distance between a print head (or a print head nozzle) and the print media. In this way, an artefact having a size (e.g. a height) exceeding the threshold distance will trigger the activation element.

Figure 5:
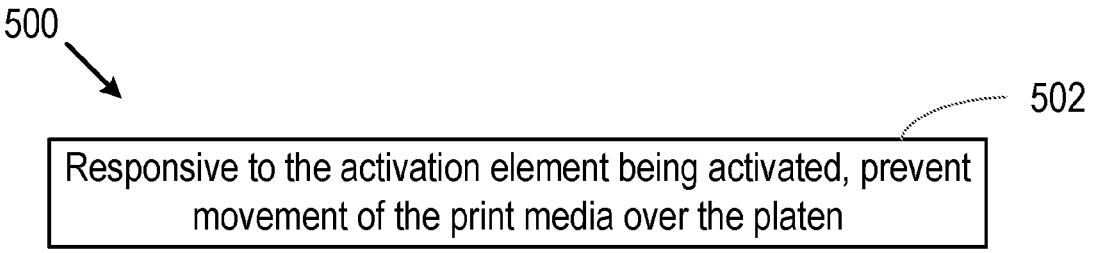
FIG. 5 is a flowchart of a further example of an artefact detection method.

FIG. 5 is a flowchart of a further example of a method 500 (e.g. an artefact detection method). The method 500 may comprise blocks of the method 400. The method 500 comprises, at block 502, responsive to the activation element being activated, preventing movement of the print media over the platen. In this way, the print media—and therefore the artefact—will be prevented from moving further towards the print head and/or nozzles, and the artefact will not be able to collide with and potentially damage the print head or nozzles.

Figure 6:
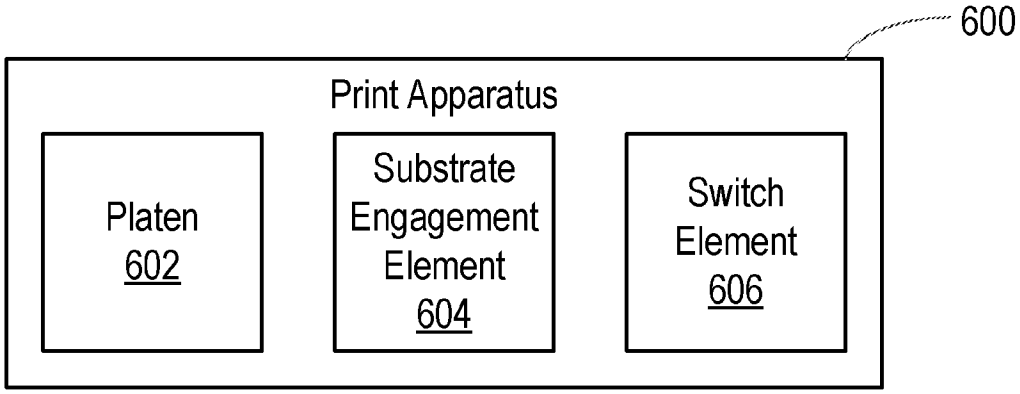
FIG. 6 is a simplified schematic of an example of a print apparatus.

A further aspect of the disclosure relates to a print apparatus. FIG. 6 is a simplified schematic of an example of a print apparatus 600. The print apparatus 600 comprises a platen 602 to support a printable substrate to be printed. The print apparatus 600 further comprises a substrate engagement element 604 to engage the printable substrate as the printable substrate moves over the platen 602. The substrate engagement element 604 may, in some examples, comprise or be similar to the detection element 110, 302 discussed above. In some examples, the substrate engagement element 604 may comprise a roller, such as the roller 114. The print apparatus 600 further comprises a switch element 606. The switch element 606 may comprise or be similar to the actuator 112 and/or the button 120. In some examples, the switch element may comprise an activation mechanism such as those discussed herein.

The substrate engagement element 604 may, in some examples, be moveable away from the platen 602 such that, in response to an artefact passing between the substrate engagement element 604 and the printable substrate, the substrate engagement element moves away from the printable substrate. In some examples, in response to the substrate engagement element 604 moving more than a defined distance away from the printable substrate, the switch element 606 is activated. Activation of the switch element 606 may be caused in manner similar to that described above, regarding to the actuator 112, 304. In some examples, the switch element 606 may be activated when the substrate engagement element 604 is moved more than a defined distance in a direction substantially normal to the printable substrate.

Figure 7:
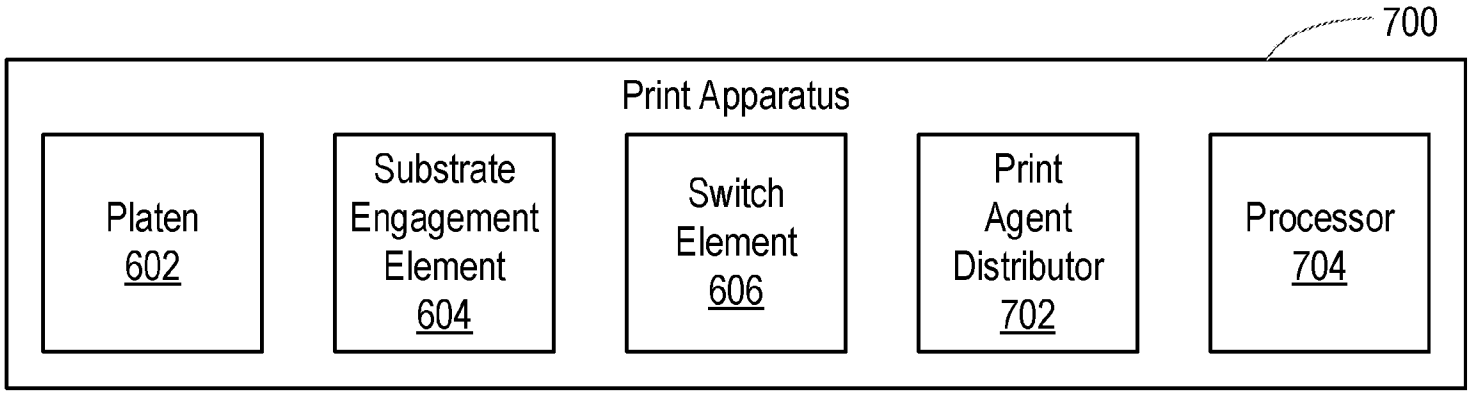
FIG. 7 is a simplified schematic of a further example of a print apparatus.

FIG. 7 is a simplified schematic of a further example of a print apparatus 700. The print apparatus 700 comprises components of the print apparatus 600 discussed above. The print apparatus 700 may further comprise a print agent distributor 702 to distribute print agent onto the printable substrate. The substrate engagement element 604 is positioned upstream of the print agent distributor 702 on a path along which the printable substrate moves over the platen 602. In this way, any artefacts of a threshold size or larger will be detected before they reach the print agent distributor 702, thereby avoiding any collisions which could damage nozzles of the print agent distributor.

In some examples, the print agent distributor 702 may be spaced apart from the platen 602 such that a separation between the print agent distributor and the printable substrate during printing is a separation distance. The defined distance may be equal or greater the separation distance. Thus, the print apparatus 600, 700 is able to detect those artefacts whose size would be such that they would be likely to crash into nozzles of the print agent distributor. The defined distance may, in some examples, be approximately 1.8 mm. In some examples, the defined distance may be from approximately 1 mm to approximately 3 mm.

The substrate engagement element 604 may, in some examples, be to apply a compressive force on the printable substrate towards the platen 602. In this way, the substrate engagement element 604 may help to align and flatten the printable substrate as it progresses towards the print agent distributor for printing. The compressive force may be provided, in some examples, by a mechanism such as the biasing arm 118 discussed above.

In some examples, the print apparatus 700 may further comprise a processor 704. In response to the switch element 606 being activated, the processor 704 may be to cause movement of the printable substrate over the platen 602 to be halted. For example the processor 704 may send a signal to another component of the print apparatus 600, 700 to instruct a substrate movement mechanism to stop moving the printable substrate towards the print agent distributor.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. An apparatus to detect an artefact on a printable surface, the apparatus comprising:

a roller element to engage the printable surface as the printable surface moves relative to the detection element, and to move away from the printable surface when the artefact passes between the roller element and the printable surface; and an actuator to be actuated in response to the roller element moving beyond a defined distance from the printable surface.

2. An apparatus according to claim 1, wherein the roller element comprises a roller to roll over the printable surface as the printable surface moves relative to the roller.

3. An apparatus according to claim 2, wherein the roller comprises a pinch roller positioned upstream of a print head of a print apparatus on a path along which the printable substrate is to move.

4. An apparatus according to claim 1, wherein the roller element is to move in a direction substantially normal to the printable surface when an artefact passes between the roller element and the printable surface.

5. An apparatus according to claim 1, wherein the roller element is to engage the actuator in response to moving beyond the defined distance from the printable substrate.

6. An apparatus according to claim 1, wherein the apparatus is to be mounted in a print apparatus having a print head to deposit ink onto the printable surface;

wherein the defined distance is equal to a distance between the print head and the printable surface.

7. An apparatus according to claim 1, wherein, in response to be actuated, the actuator is to prevent movement of the printable surface relative to the roller element.

8. An apparatus according to claim 1, wherein the roller element is one of a plurality of roller elements and the actuator is one of a plurality of actuators;

wherein each actuator is independently actuatable in response to a corresponding one of the plurality of roller elements moving beyond a defined distance from the printable surface.

9. An artefact detection method comprising:

providing a roller element such that the roller element is to contact print media as the print media moves over a platen, the roller element being moveable away from the platen when an artefact passes between the print media and the roller element; and providing an activation element such that, responsive to the roller element moving beyond a threshold distance away from the print media, the activation element is to be activated.

10. A method according to claim 9, further comprising:

responsive to the activation element being activated, preventing movement of the print media over the platen.

11. A print apparatus comprising:

a platen to support a printable substrate to be printed;

a roller element to engage the printable substrate as the printable substrate moves over the platen; and a switch element;

wherein the roller element is moveable away from the platen such that, in response to an artefact passing between the roller element and the printable substrate, the roller element moves away from the printable substrate; and wherein, in response to the roller element moving more than a defined distance away from the printable substrate, the switch element is activated.

12. A print apparatus according to claim 11, further comprising:

a print agent distributor to distribute print agent onto the printable substrate;

wherein the roller element is positioned upstream of the print agent distributor on a path along which the printable substrate moves over the platen.

13. A print apparatus according to claim 12, wherein the print agent distributor is spaced apart from the platen such that a separation between the print agent distributor and the printable substrate during printing is a separation distance; and wherein the defined distance is equal or greater the separation distance.

14. A print apparatus according to claim 11, wherein roller element is to apply a compressive force on the printable substrate towards the platen.

15. A print apparatus according to claim 11, further comprising:

a processor;

wherein, in response to the switch element being activated, the processor is to cause movement of the printable substrate over the platen to be halted.

* * * * *